US009279380B2

(12) United States Patent
Hergart et al.

(10) Patent No.: US 9,279,380 B2
(45) Date of Patent: Mar. 8, 2016

(54) SYSTEM AND METHOD FOR ESTIMATING AND CONTROLLING TEMPERATURE OF ENGINE COMPONENT

(71) Applicant: Caterpillar Inc., Peoria, IL (US)

(72) Inventors: Carl A. Hergart, Peoria, IL (US); Jason J. Rasmussen, Hopewell, IL (US)

(73) Assignee: Caterpillar Inc., Peoria, IL (US)

( * ) Notice: Subject to any disclaimer, the term of this patent is extended or adjusted under 35 U.S.C. 154(b) by 343 days.

(21) Appl. No.: 14/018,671

(22) Filed: Sep. 5, 2013

(65) Prior Publication Data

US 2015/0059691 A1 Mar. 5, 2015

(51) Int. Cl.

| | |
|---|---|
| ***F02D 41/00*** | (2006.01) |
| ***F02D 41/38*** | (2006.01) |
| ***F02D 41/22*** | (2006.01) |

(52) U.S. Cl.

CPC ..... *F02D 41/38* (2013.01); *F02D 41/22* (2013.01); *F02D 2200/022* (2013.01)

(58) Field of Classification Search

CPC ..... F02D 1/025; F02D 35/025; F02D 35/026; F02D 2200/0414; F02D 2200/0416

USPC ..... 73/114.32, 114.33, 114.34, 114.25, 73/114.38, 114.68; 701/101, 102, 103, 701/104, 106, 110, 112, 113, 115; 702/130

See application file for complete search history.

(56) References Cited

U.S. PATENT DOCUMENTS

| | | | | |
|---|---|---|---|---|
| 5,483,941 | A | 1/1996 | Cullen et al. | |
| 5,931,140 | A * | 8/1999 | Maloney | F02D 41/0072 123/480 |
| 5,983,876 | A | 11/1999 | Irons et al. | |
| 6,003,496 | A * | 12/1999 | Maloney | F20D 41/047 123/480 |
| 6,941,245 | B2 * | 9/2005 | Longnecker | F01P 7/167 702/184 |
| 8,989,989 | B2 * | 3/2015 | Sczomak | F02D 41/401 123/689 |
| 2013/0008417 | A1 | 1/2013 | Sankar et al. | |
| 2013/0073173 | A1 * | 3/2013 | Hellstrom | F02D 41/3035 701/101 |

* cited by examiner

*Primary Examiner* — Hai Huynh
*Assistant Examiner* — Raza Najmuddin

(57) ABSTRACT

An engine system is provided. The engine system includes an ambient air pressure sensor configured to generate a signal indicative of a pressure of ambient air. The engine system also includes an operational parameter sensor configured to generate a signal indicative of one or more operational parameters associated with the engine. The engine system further includes a controller communicably coupled to the ambient air pressure sensor and the operational parameter sensor. The controller is configured to receive the signal indicative of the pressure of ambient air and the signal indicative of the one or more operational parameters associated with the engine. The controller estimates the temperature of at least one of a valve, a piston, a liner, a cylinder head, and a pre-chamber of the engine as a function of the received signals and parameters associated with fuel delivery in a single fuel cycle of the engine.

17 Claims, 3 Drawing Sheets

SYSTEM AND METHOD FOR ESTIMATING AND CONTROLLING TEMPERATURE OF ENGINE COMPONENT

TECHNICAL FIELD

The present disclosure relates to a system and method for estimating and controlling a temperature of an engine component, and more specifically for the estimation and control of the temperature of a valve, a piston, a liner, a cylinder head, and a pre-chamber associated with an engine.

BACKGROUND

For a given configuration, an Internal Combustion Engine (ICE) operating at a higher altitude tends to reach higher temperatures as compared to the engine operating at a lower altitude when producing a same amount of power. This may cause overheating of engine components, such as, for example valves, pistons, and other in-cylinder components associated with the engine. Overheating may in turn lead to premature failure of the valve. In order to prevent overheating, the engine is derated by reducing a fuel supply to the engine. Typical calibration strategies consider constraints such as exhaust gas temperature, peak cylinder pressure, turbocharger speed, compressor outlet temperature, and smoke opacity. Such strategies fail to consider a temperature of the valve, a piston, a liner, a cylinder head, and a pre-chamber, which in some situations may be a limiting factor in the system.

Some prior attempts to account for the valve temperature limitations include correlating it with the exhaust gas temperature. Such an approach is typically inaccurate, since the valve temperatures are more aligned with peak cylinder temperatures during a cycle than the exhaust gas temperature. Other derate strategies may involve advancing injection timing for the sake of reducing the exhaust gas temperature. This may lead to a more substantial pre-burned spike, relatively higher exhaust gas temperatures and in turn cause an increase in the temperature of the valve.

U.S. Pat. No. 5,483,941 discloses a method for use with a vehicle including a multi-cylinder internal combustion engine having exhaust valves. The method controls the temperature of the exhaust valves during fuel cutoff modes of engine operation utilizing a bit pattern representation of the engine cylinders. The method includes cutting off the fuel delivered to the cylinders in an indexed cylinder firing pattern to vary which cylinders receive fuel so as to maintain acceptable exhaust valve temperature levels. The method may also include operating the engine with a lean air/fuel ratio so as to maintain acceptable catalytic converter temperature levels.

SUMMARY OF THE DISCLOSURE

In one aspect, an engine system is disclosed. The engine system includes an ambient air pressure sensor configured to generate a signal indicative of a pressure of ambient air. The engine system also includes an operational parameter sensor configured to generate a signal indicative of one or more operational parameters associated with the engine. The engine system further includes a controller communicably coupled to the ambient air pressure sensor and the operational parameter sensor. The controller is configured to receive the signal indicative of the pressure of ambient air and the signal indicative of the one or more operational parameters associated with the engine. The controller estimates the temperature of at least one of a valve, a piston, a liner, a cylinder head, and a pre-chamber of the engine as a function of the received signals and parameters associated with fuel delivery in a single fuel cycle of the engine.

In another aspect, a method for determining a temperature of a component of an engine is disclosed. The method includes receiving a signal indicative of a pressure of ambient air. The method includes receiving a signal indicative of one or more operational parameters associated with the engine. The method further includes estimating the temperature of a valve, a piston, a liner, a cylinder head, and a pre-chamber of the engine as a function of the received signals and parameters associated with fuel delivery in a single fuel cycle of the engine.

DETAILED DESCRIPTION

Reference will now be made in detail to specific embodiments or features, examples of which are illustrated in the accompanying drawings. Generally, corresponding or similar reference numbers will be used, when possible, throughout the drawings to refer to the same or corresponding parts.

Figure 1:
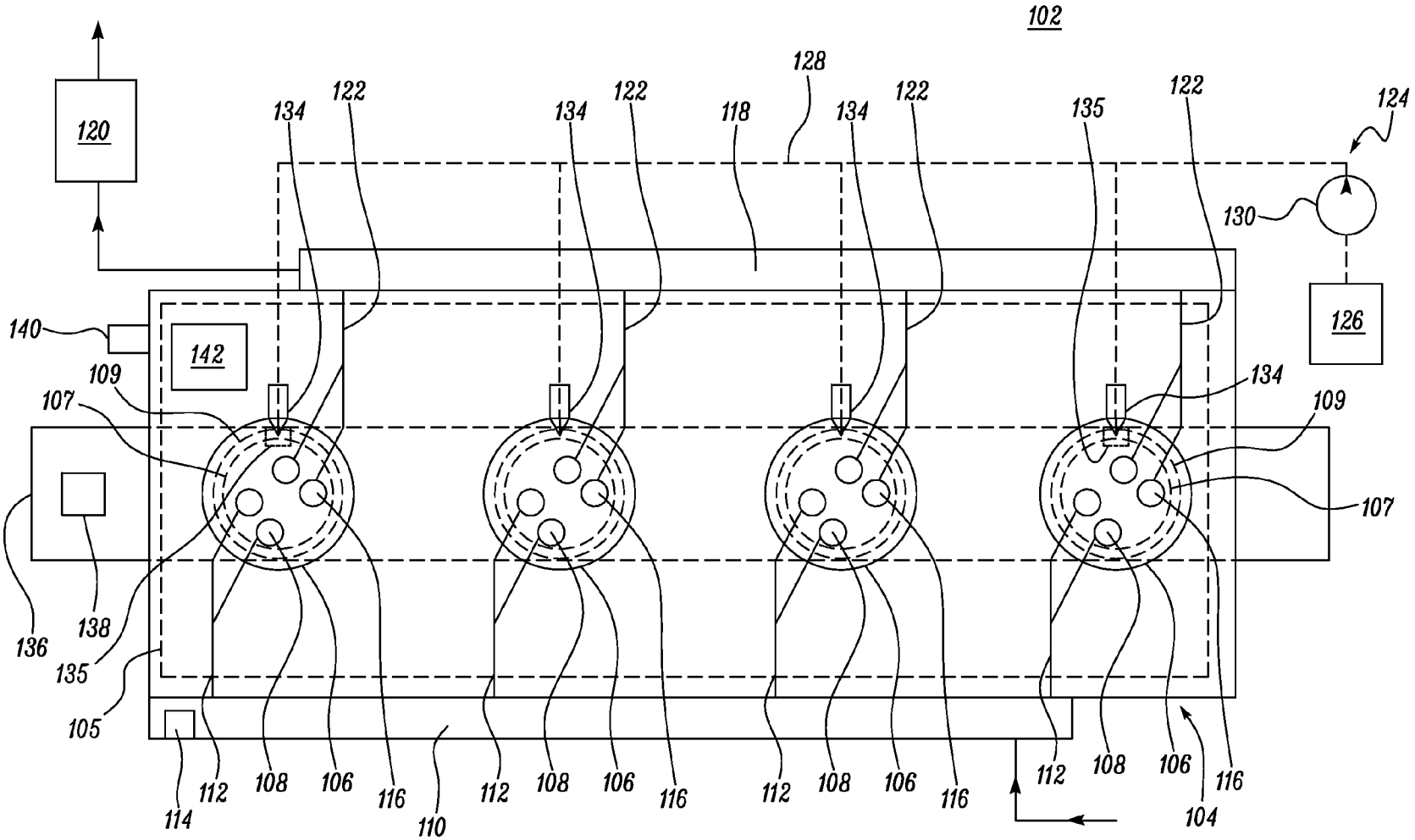
FIG. 1 illustrates an exemplary block diagram of an engine including valves, pistons, liners, a cylinder head, and a pre-chamber associated with the engine.

Referring to FIG. 1, a block diagram of an exemplary engine 102 is illustrated. In one embodiment, the engine 102 may include a compression ignition engine configured to combust a mixture of air and diesel fuel. In alternative embodiments, the engine 102 may include a spark ignition engine such as a natural gas engine, a gasoline engine, or any multi-cylinder reciprocating internal combustion engine known in the art. The engine 102 includes an engine block 104 and a cylinder head 105. The engine block 104 includes a plurality of cylinders 106. Each of the plurality of cylinders 106 includes a piston 107 and a liner 109 disposed within the cylinder 106. Although four cylinders 106 are shown in an inline configuration, in other embodiments fewer or more cylinders 106 may be included or another configuration such as a V-configuration may be employed. The engine 102 may be configured for any suitable application such as motor vehicles, work machines, locomotives or marine engines, and in stationary applications such as electrical power generators.

Each cylinder 106 includes one or more intake valves 108. The intake valves 108 may be configured to supply air for combustion with a fuel in the cylinder 106. In the illustrated embodiment, the intake valves 108 are provided at the top of the cylinder 106. Alternatively, the intake valves 108 may be placed at other locations such as through a sidewall of the cylinder 106. An intake manifold 110 may be formed or attached to the engine block 104 such that the intake manifold 110 extends over or is proximate to each of the cylinders 106.

Fluid communication between the intake manifold 110 and the cylinders 106 may be established by a plurality of intake runners 112 extending from the intake manifold 110 to the cylinders 106. Additionally, an intake air system (not shown) may be provided in fluid communication with the intake manifold 110 in order to direct air to the engine 102. The intake air system may include a number of components known in the art including, but not limited to, a turbocharger and an air filter.

An operational parameter sensor like an intake manifold temperature sensor 114 may be provided in association with the intake manifold 110. The intake manifold temperature sensor 114, hereinafter referred to as a temperature sensor 114, may be any sensor known in the art configured for sensing of a temperature of the intake manifold 110. The temperature sensor 114 may include, but not limited to, thermocouple, thermistor, resistance type temperature sensor, infrared sensor and silicon bandgap type temperature sensor. The temperature sensor 114 may be configured to generate a temperature signal S1 (shown in relation to FIG. 2) indicative of the temperature of the intake manifold 110 and/or air present in the intake manifold 110.

The cylinders 106 may include one or more exhaust valves 116. The exhaust valves 116 may be configured to exit exhaust gas from the cylinders 106 after combustion events. An exhaust manifold 118 communicating with an exhaust system 120 may also be disposed in or proximate to the engine block 104. The exhaust manifold 118 receives exhaust gases through the exhaust valves 116 associated with each cylinder 106. The exhaust manifold 118 may fluidly communicate with the cylinders 106 through exhaust runners 122 extending from the exhaust manifold 118.

In order to supply the fuel that the engine 102 combusts during the combustion process, a fuel system 124 is operatively associated with the engine 102. The fuel system 124 may include a fuel reservoir 126. The fuel reservoir 126 may be configured to accommodate the fuel such as diesel fuel. Although only one fuel reservoir 126 is depicted in the illustrated embodiment, it will be appreciated that in other embodiments additional fuel reservoirs 126 may be included to accommodate the same or different types of fuels required in the combustion process. A fuel line 128 may be provided in the fuel system 124 to direct the fuel from the fuel reservoir 126 to the engine 102. A fuel pump 130 may be provided in the fuel line 128 to pressurize and force the fuel through the fuel line 128. The fuel system 124 may include multiple fuel injectors 134 fluidly coupled to the fuel line 128 to introduce the fuel into the cylinders 106. At least one fuel injector 134 may be associated with each cylinder 106. In one embodiment, when the engine 102 is the natural gas engine, a pre-chamber 135 may be provided in association with the cylinder 106 and the fuel injector 134.

In the illustrated embodiment, one fuel injector 134 is associated with each cylinder 106. In other embodiments, a different number of injectors 134 may be used. Additionally, in the illustrated embodiment, the fuel line 128 terminates at the fuel injectors 134. In an alternate embodiment, the fuel line 128 may establish a fuel loop in a manner such that the fuel continuously circulates through the plurality of fuel injectors 134 and, optionally, delivers unused fuel back to the fuel reservoir 126. In some embodiments the fuel line 128 may include a fuel collector volume or rail (not shown), which may supply pressurized fuel to the fuel injectors 134. The fuel injectors 134 may be electrically actuated devices for selectively introducing a predetermined quantity of the fuel to each cylinder 106. In other embodiments, the fuel may be introduced in the intake manifold 110, the intake runners 112 or upstream of the turbocharger.

Each of the cylinders 106 includes the piston 107 and a connecting rod assembly (not shown). During the combustion of the mixture of air and the fuel introduced in the cylinders 106, high pressure is generated within the cylinders 106. This high pressure acts on the piston 107 and causes a translatory motion of the piston 107 within the cylinder 106. The piston 107 is pivotally connected to one end of the connecting rod. Other end of the connecting rod is connected to a crankshaft 136. The connecting rod is configured to convert a translatory motion of the piston 107 to a rotary motion of the crankshaft 136.

The number of rotations of the crankshaft 136 defines a speed of the engine 102. An operational parameter sensor like an engine speed sensor 138, hereinafter interchangeably referred to as a speed sensor 138, may be coupled to the crankshaft 136. The speed sensor 138 may be configured to generate a speed signal S2 (shown in relation to FIG. 2) indicative of the speed of the engine 102. The speed sensor 138 may be any sensor known in the art for sensing of the speed, for example, an optical sensor, an inductive sensor or a Hall Effect sensor. In another embodiment, the operational parameter sensor may be any other sensor, such as, for example a torque sensor. It should be noted that the operational parameter sensor may be replaced by any other suitable sensor known in the art configured to generate a signal indicative of a required operational parameter as per system design and requirements.

The engine 102 may include an ambient pressure sensor 140, hereinafter referred to as a pressure sensor 140. The pressure sensor 140 may be configured to generate a pressure signal S3 (shown in relation to FIG. 2) indicative of a pressure of ambient air in which the engine 102 is operating. In an alternate embodiment, the pressure sensor 140 may be an intake manifold pressure sensor. Accordingly, in such a situation, the pressure signal S3 may be indicative of a pressure of the intake manifold of the engine 102.

The engine 102 includes a controller 142 configured to determine the temperature associated with a valve, the piston 107, the liner 109, the cylinder head 105, and/or a pre-chamber 135 of the engine 102. It should be noted that the valve may include the intake valve 108 and/or the exhaust valve 116 associated with the engine. The location of the controller 142 shown in the accompanying figures is merely on an illustrative basis. The controller 142 may be located extrinsic or intrinsic to the engine 102. The controller 142 is communicably coupled to the temperature sensor 114, the speed sensor 138, the pressure sensor 140, and components of the fuel system 124 like the fuel pump 130 and the fuel injectors 134.

The controller 142 may embody a single microprocessor or multiple microprocessors that includes a means for receiving signals from the components of the temperature estimation system 202. Numerous commercially available microprocessors may be configured to perform the functions of the controller 142. It should be appreciated that the controller 142 may readily embody a general machine microprocessor capable of controlling numerous machine functions. A person of ordinary skill in the art will appreciate that the controller 142 may additionally include other components and may also perform other functionality not described herein.

Figure 2:
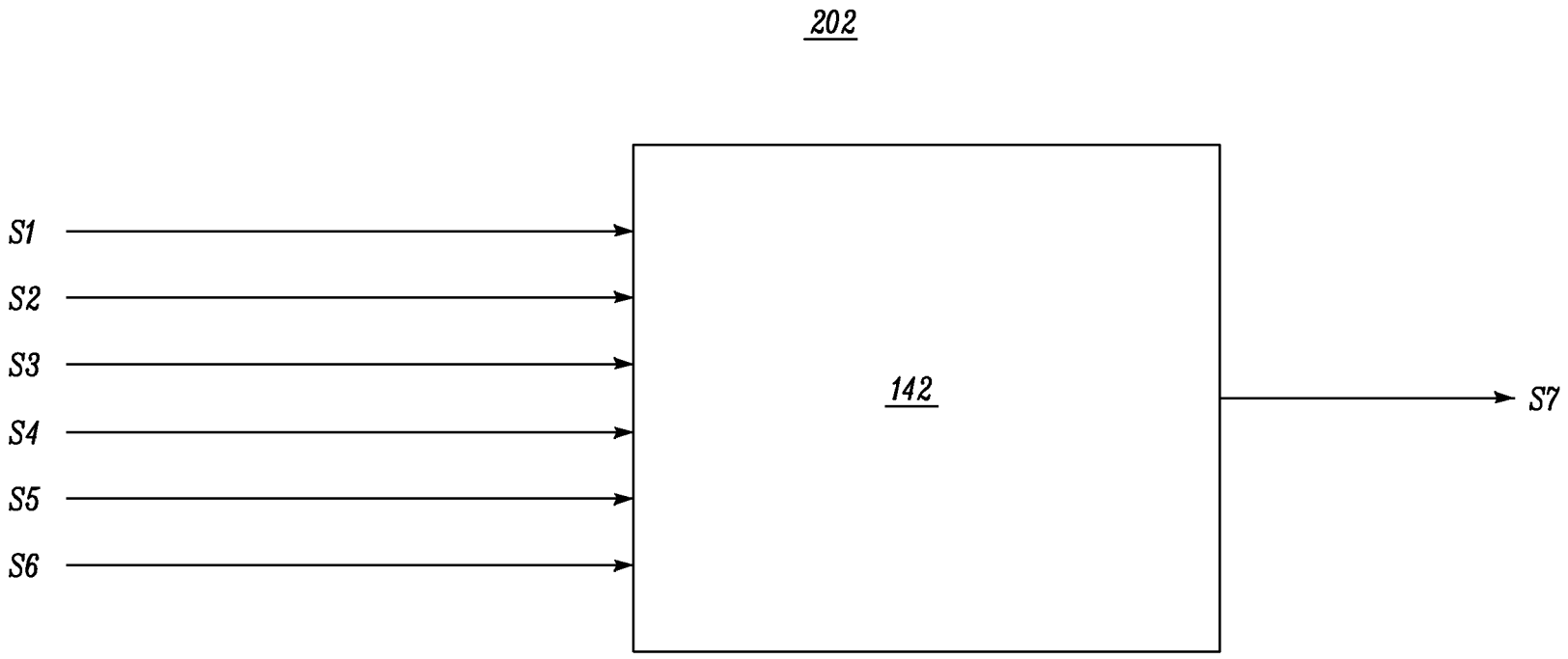
FIG. 2 illustrates an exemplary block diagram of a temperature estimation system.

Referring to FIG. 2, a block diagram of a temperature estimation system 202 is illustrated. The controller 142 may be configured to receive the temperature signal S1, the speed signal S2 and the pressure signal S3 from the temperature sensor 114, the speed sensor 138 and the pressure sensor 140 respectively. The controller 142 may be configured to determine one or more parameters associated with fuel delivery in a single fuel cycle of the engine 102. The parameters may include signals indicative of, but not limited to, a fuel rate, a fuel injection timing and a fuel injection schedule denoted as S4, S5, S6 respectively in the accompanying figures.

The term "fuel rate signal" (S4) refers to the predetermined quantity of the fuel required to be injected into each of the cylinders 106 by the respective fuel injector 134 for efficient combustion in each cycle. A fuel rate of each cycle is based on a load demand of the engine 102. In one embodiment, the load demand may correspond to a position of a throttle associated with the engine 102. In another embodiment, the load demand may be associated with an operational parameter, such as a speed, of a governor of the engine 102.

The term "fuel injection timing signal" (S5) refers to a signal indicative of a predetermined time at which a relatively large quantity of the fuel is injected into each of the cylinders 106 by the respective fuel injector 134 in the single fuel cycle. The injection of the relatively large quantity of the fuel may be considered as a main fuel injection of the fuel cycle.

The term "the fuel injection schedule signal" (S6) refers to the way in which fuel is injected into the cylinders 106. Fuel may either be injected all at once or through a series of pulses.

The controller 142 may determine the above mentioned parameters by any known methods known in the art. For example, in one embodiment, the controller 142 may receive signals from various sensors associated with the engine 102, such as, for example, an engine load sensor, an engine temperature sensor, the speed sensor 138, the pressure sensor 140 or any other sensor as per system design. Based on the received signals, the controller 142 may be configured to determine the fuel rate signal S4, the fuel injection timing signal S5 and the fuel injection schedule signal S6.

In another embodiment, the operational parameter of the governor of the engine 102 may be used to determine the fuel rate signal S4 by any method known in the art. The fuel rate signal S4 may be received by the controller 142 to further determine the fuel injection timing signal S5 and the fuel injection schedule signal S6. It should be noted that determination of the fuel rate signal S4, the fuel injection timing signal S5 and the fuel injection schedule signal S6 may be done by any method known to one skilled in the art and may not limit the scope of the disclosure.

The controller 142 is configured to estimate the temperature of the valve 108, 116, the piston 107, the liner 109, the cylinder head 105, and/or a pre-chamber 135 as a function of the temperature signal S1, the speed signal S2, the pressure signal S3, the fuel rate signal S4, the fuel injection timing signal S5, and the fuel injection schedule signal S6. The controller 142 is configured to generate an output signal S7 indicative of the estimated temperature of the valve 108, 116, the piston 107, the liner 109, the cylinder head 105, and/or the pre-chamber 135.

The estimation of the temperature of the valve 108, 116, the piston 107, the liner 109, the cylinder head 105 and/or the pre-chamber 135 may be done in different ways. In one embodiment, the controller 142 may be configured to correlate the temperature signal S1, the speed signal S2, the pressure signal S3, the fuel rate signal S4, the fuel injection timing signal S5, and the fuel injection schedule signal S6 with a pre-calibrated reference map stored in a database (not shown) or an internal memory of the controller 142. The reference map may include pre-calibrated readings corresponding to the temperature of the valve 108, 116, the piston 107, the liner 109, the cylinder head 105 and/or the pre-chamber 135 against different values of the temperature signal S1, the speed signal S2, the pressure signal S3, the fuel rate signal S4, the fuel injection timing signal S5, and the fuel injection schedule signal S6.

In another embodiment, the controller 142 may be configured to compute the temperature of the valve 108, 116, the piston 107, the liner 109, the cylinder head 105, and/or the pre-chamber 135 based on a predetermined mathematical equation. This, mathematical equation may include a multiple polynomial regression model, a physics based model, a neural network model or any other model or algorithm known in the art. Hence, the output signal S7 may be indicative of an instantaneous estimation of the temperature of the valve 108, 116, the piston 107, the liner 109, the cylinder head 105, and/or the pre-chamber 135 as determined by the controller 142 based on the above mentioned factors.

There is a thermal inertia associated with a material of the valve 108, 116, the piston 107, the liner, the cylinder head 105 and/or the pre-chamber 135. Due to the thermal inertia, the valve 108, 116, the piston 107, the liner 109, the cylinder head 105 and/or the pre-chamber 135 may attain an equilibrium temperature state only after a duration of time. Because of a time delay in reaching an equilibrium temperature, in some instances, the temperature of the valve 108, 116, the piston 107, the liner 109, the cylinder head 105 and/or the pre-chamber 135 as estimated by the controller 142 may be higher than that of an actual temperature of the valve 108, 116, the piston 107, the liner 109, the cylinder head 105 and/or the pre-chamber 135 respectively.

In one embodiment, the controller 142 may be configured to monitor the temperature of the valve 108, 116, the piston 107, the liner 109, the cylinder head 105 and/or the pre-chamber 135 over a predetermined time period. In another embodiment, a low pass filter may be coupled to the controller 142, such that the thermal inertia of the material of the valve 108, 116, the piston 107, the liner 109, the cylinder head 105 and/or the pre-chamber 135 is accounted for through filtering of the output signal S7. A person of ordinary skill in the art will appreciate that other known methods may also be utilized to filter the output signal S7.

When the engine 102 is operating at relatively high altitudes, the temperature of the valve 108, 116, the piston 107, the liner 109, the cylinder head 105 and/or the pre-chamber 135 may increase at a more rapid rate as compared to that when the engine 102 is operating at lower altitudes. If the temperature of the valve 108, 116, the piston 107, the liner 109, the cylinder head 105 and/or the pre-chamber 135 rises above a particular operational temperature, the respective component may fail.

In additional embodiments of the present disclosure, the controller 142 may employ a derate control strategy wherein the controller 142 is configured to derate the engine 102 based on the estimated temperature of the valve 108, 116, the piston 107, the liner 109, the cylinder head 105 and/or the pre-chamber 135. It is of interest to minimize the derate of the engine 102. More specifically, the controller 142 is configured to derate the engine 102 when the estimated temperature of the valve 108, 116, the piston 107, the liner 109, the cylinder head 105 and/or the pre-chamber 135 is equal to or exceeds a respective predetermined threshold. The predetermined threshold may be a maximum allowable temperature of the valve 108, 116, the piston 107, the liner 109, the cylinder head 105 and/or the pre-chamber 135 and may vary based on the material of the valve 108, 116, the piston 107, the liner 109, the cylinder head 105 and/or the pre-chamber 135, respectively. Alternatively, in one embodiment, the predetermined threshold may be a percentage of the maximum allowable temperature of the valve 108, 116, the piston 107, the liner 109, the cylinder head 105 and/or the pre-chamber 135.

The derate of the engine 102 may be performed using any methods for engine derate known in the art. For example, a supply of the fuel to the one or more cylinders 106 may be reduced or terminated in order to derate the engine 102. As a result, the combustion of the fuel in the cylinders 106 may be reduced leading to fall in the temperature of the valve 108, 116, the piston 107, the liner 109, the cylinder head 105 and/or the pre-chamber 135. In one embodiment, the controller 142 may be configured to determine an extent or duration of the derate of the engine 102 based on factors such as controlling a quantity of reduction in the fuel supply to the cylinders 106.

The extent of the derate may be based on a difference between the estimated temperature of the valve 108, 116, the piston 107, the liner 109, the cylinder head 105 and/or the pre-chamber 135 and the respective predetermined threshold. Further, the controller 142 may be configured to continuously monitor the estimated temperature of the valve 108, 116, the piston 107, the liner 109, the cylinder head 105 and/or the pre-chamber 135 during the derate. Moreover, when the monitored temperature of the valve 108, 116, the piston 107, the liner 109, the cylinder head 105 and/or the pre-chamber 135 reaches or falls below the respective predetermined threshold, the controller 142 may be configured to deactivate the derate control strategy. It should be understood that the embodiments and the configurations and connections explained herein are merely on an exemplary basis and may not limit the scope and spirit of the disclosure.

INDUSTRIAL APPLICABILITY

High operating temperatures may cause premature failure of intake or exhaust valves on an engine, leading to engine downtime and increased maintenance cost. To prevent such a situation, engine derate may be employed to operate the engine within allowable temperature limits Derate of the engine may prevent the associated components of the engine, such as valves, pistons, liners, cylinder head and/or the pre-chamber from attaining excessively high operating temperatures which might cause damage to the component.

The controller 142 disclosed herein is configured to estimate the temperature of the valve 108, 116, the piston 107, the liner 109, the cylinder head 105 and/or the pre-chamber 135 as a function of the temperature signal S1, the speed signal S2, the pressure signal S3 and the parameters associated with fuel delivery in the single fuel cycle of the engine 102. The derate control strategy adopted by the controller 142 may be more robust and efficient.

Figure 3:
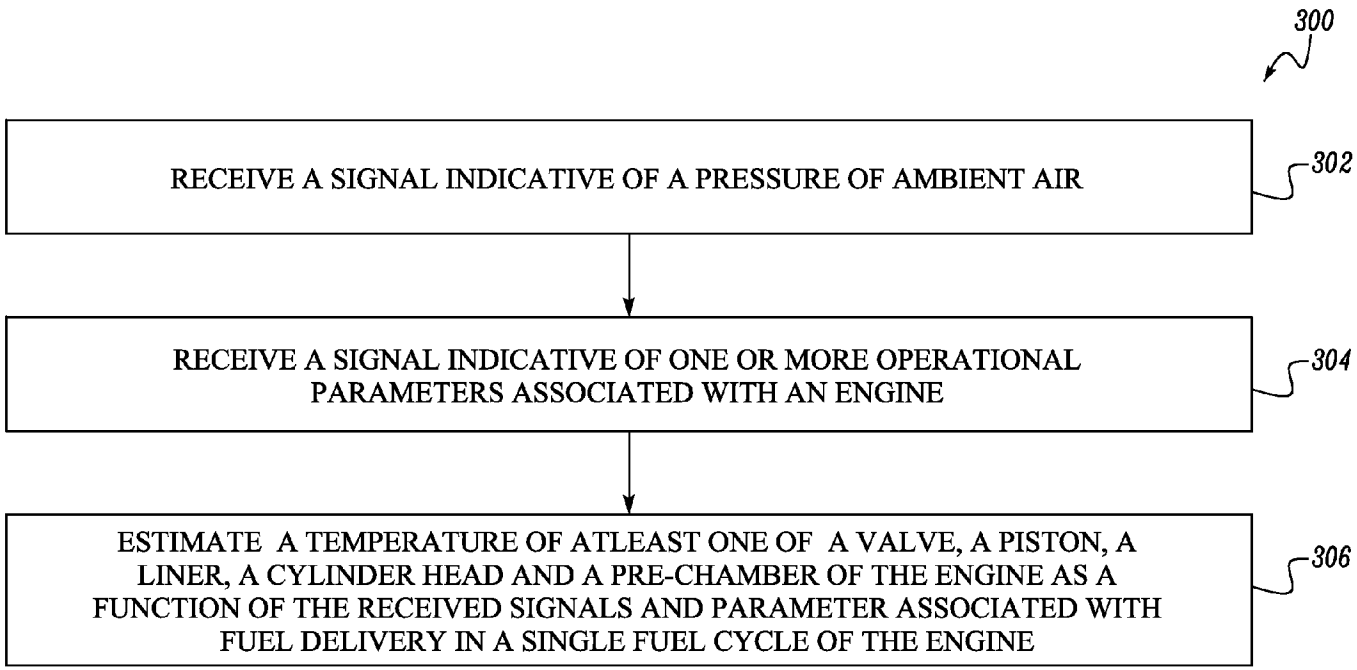
FIG. 3 illustrates an exemplary flowchart of a method of determining a temperature of the valve, the piston, the liner, the cylinder head, and the pre-chamber of the engine.

FIG. 3 illustrates a flowchart of a method 300 for estimating the temperature of the valve 108, 116, the piston 107, the liner 109, the cylinder head 105 and/or the pre-chamber 135. At step 302, the controller 142 receives the pressure signal S3 indicative of the pressure of ambient air.

At step 304, the controller 142 receives the signal indicative of the one or more operational parameters associated with the engine 102. More specifically, the controller 142 receives the speed signal S2 indicative of the speed of the engine 102 and the temperature signal S1 indicative of the temperature of the intake manifold 110 of the engine 102.

At step 306, the controller 142 estimates the temperature of the valve 108, 116, the piston 107, the liner 109, the cylinder head 105 and/or the pre-chamber 135 of the engine 102 as the function of the temperature signal S1, the speed signal S2, the pressure signal S3 and the parameters associated with the fuel delivery in the single fuel cycle of the engine 102. These parameters include the fuel rate signal S4, the fuel injection timing signal S5 and the fuel injection schedule signal S6.

In one embodiment, the controller 142 may estimate the temperature of the valve 108, 116, the piston 107, the liner 109, the cylinder head 105 and/or the pre-chamber 135 by correlating the temperature signal S1, the speed signal S2, the pressure signal S3, the fuel rate signal S4, the fuel injection timing signal S5, and the fuel injection schedule signal S6 with the pre-calibrated reference map. In another embodiment, the controller 142 may compute the temperature of the valve 108, 116, the piston 107, the liner 109, the cylinder head 105 and/or the pre-chamber 135 as the function of the temperature signal S1, the speed signal S2, the pressure signal S3, the fuel rate signal S4, the fuel injection timing signal S5, and the fuel injection schedule signal S6.

In additional embodiments, the controller 142 may monitor the temperature of the valve 108, 116, the piston 107, the liner 109, the cylinder head 105 and/or the pre-chamber 135 over the time period for estimating the temperature of the valve 108, 116, the piston 107, the liner 109, the cylinder head 105 and/or the pre-chamber 135, respectively. Also, as explained earlier, the controller 142 may derate the engine 102 when the estimated temperature of the valve 108, 116, the piston 107, the liner 109, the cylinder head 105 and/or the pre-chamber 135 exceeds the respective predetermined threshold.

From the foregoing it will be appreciated that, although specific embodiments have been described herein for purposes of illustration, various modifications or variations may be made without deviating from the spirit or scope of inventive features claimed herein. Other embodiments will be apparent to those skilled in the art from consideration of the specification and figures and practice of the arrangements disclosed herein. It is intended that the specification and disclosed examples be considered as exemplary only, with a true inventive scope and spirit being indicated by the following claims and their equivalents.

What is claimed is:

1. An engine system comprising:

an ambient air pressure sensor configured to generate a signal indicative of a pressure of ambient air;

at least one operational parameter sensor configured to generate at least one signal indicative of one or more operational parameters associated with the engine; and a controller communicably coupled to the ambient air pressure sensor and the at least one operational parameter sensor, the controller configured to:

receive the signal indicative of the pressure of ambient air;

receive the at least one signal indicative of the one or more operational parameters associated with the engine;

determine one or more parameters associated with fuel delivery; and estimate a temperature of an exhaust valve as a function of the received signals and determined parameters.

2. The system of claim 1, wherein the parameters include a fuel rate, a fuel injection timing and a fuel injection schedule.

3. The system of claim 2, wherein the fuel rate is derived from a load demand associated with the engine.

4. The system of claim 1, wherein the one or more operational parameters include a speed of the engine and a temperature of an intake manifold of the engine.

5. The system of claim 1, wherein the controller is further configured to correlate the received signals with a pre-calibrated map for estimating the temperature of the exhaust valve.

6. The system of claim 1, wherein the controller is further configured to compute the temperature of the exhaust valve as the function of the received signals and the parameters associated with fuel delivery.

7. The system of claim 1, wherein the controller is further configured to derate the engine when the estimated temperature of the exhaust valve exceeds a predetermined threshold.

8. The system of claim 1, wherein the controller is further configured to monitor the temperature of the exhaust valve over a predetermined time period for estimating the temperature of the exhaust valve.

9. The system of claim 1, wherein the system is employed on a machine.

10. A method for determining a temperature of a component of an engine, the method comprising:

receiving a signal indicative of a pressure of ambient air;

receiving at least one signal indicative of one or more operational parameters associated with the engine;

determining one or more parameters associated with fuel delivery; and estimating the temperature of an exhaust valve as a function of the received signals and determined parameters.

11. The method of claim 10, wherein the parameters include a fuel rate, a fuel injection timing and a fuel injection schedule.

12. The method of claim 11 further comprising deriving the fuel rate from a load demand associated with the engine.

13. The method of claim 10, wherein the one or more operational parameters associated with the engine include a speed of the engine and a temperature of an intake manifold of the engine.

14. The method of claim 10, wherein the estimating step further comprises correlating the received signals with a pre-calibrated map.

15. The method of claim 10, wherein the estimating step further comprises computing the temperature of the exhaust valve as a function of the received signals and the parameters associated with fuel delivery.

16. The method of claim 10 further comprising derating the engine when the estimated temperature of the exhaust valve exceeds a respective predetermined threshold.

17. The method of claim 10 further comprising monitoring the temperature of the exhaust valve over a time period for the estimation of the temperature of the exhaust valve.

* * * * *